US006293265B1

(12) United States Patent
Gagnon

(10) Patent No.: US 6,293,265 B1
(45) Date of Patent: Sep. 25, 2001

(54) EXHAUST GAS RECIRCULATION SYSTEM

(75) Inventor: Frederic Gagnon, Chatham (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/411,109

(22) Filed: Oct. 4, 1999

(51) Int. Cl.[7] ..... F02M 25/07
(52) U.S. Cl. ..... 123/568.17; 165/52
(58) Field of Search ..... 123/568.11, 568.12, 123/568.17; 165/51, 52, 56

(56) References Cited

U.S. PATENT DOCUMENTS 4,741,295 * 5/1988 Hosoya et al. ..... 123/184.31
4,938,176 * 7/1990 Tanaka et al. ..... 123/568.17
5,207,714 * 5/1993 Hayashi et al. ..... 123/568.17
5,425,347 * 6/1995 Zinke, II ..... 123/568.11
5,433,183 * 7/1995 Vansnick ..... 123/568.11
5,492,104 * 2/1996 Elder et al. ..... 123/568.17
5,542,711 * 8/1996 Vaudry ..... 285/41
5,970,960 * 10/1999 Azuma ..... 123/568.12

FOREIGN PATENT DOCUMENTS 63-164554 * 10/1988 (JP) .

* cited by examiner

*Primary Examiner*—Andrew M. Dolinar
*Assistant Examiner*—Arnold Castro

(57) ABSTRACT

An integral heat sink for transferring heat from combustion exhaust gas produced by a vehicular internal combustion engine is disclosed. The heat sink includes a body providing an integral base configured for support by a manifold. The heat sink also includes a hollow elongate member providing a first portion contained in the body. The first portion has an exhaust gas intake. The member also includes a second portion extending from the body. The second portion is configured for insertion into the manifold and provides at least one discharge for the exhaust gas. The heat sink also includes a cavity disposed between the body and the member. The cavity is configured for conveying combustion air from the manifold around at least a portion of the member.

13 Claims, 2 Drawing Sheets

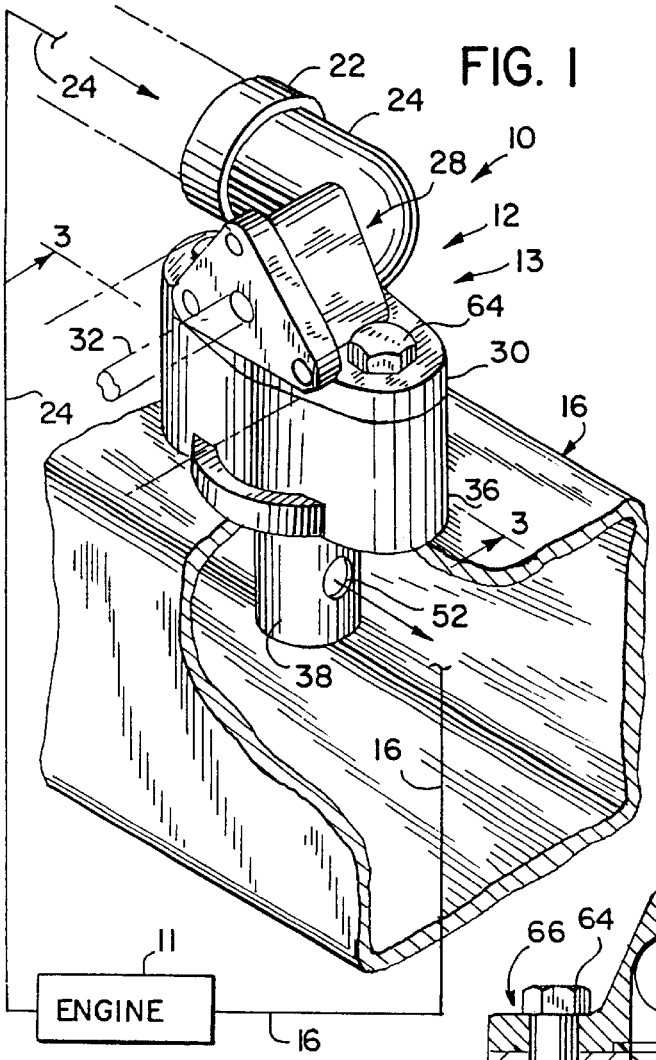
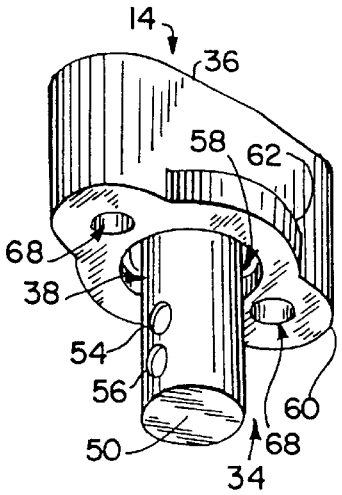
FIG. 2
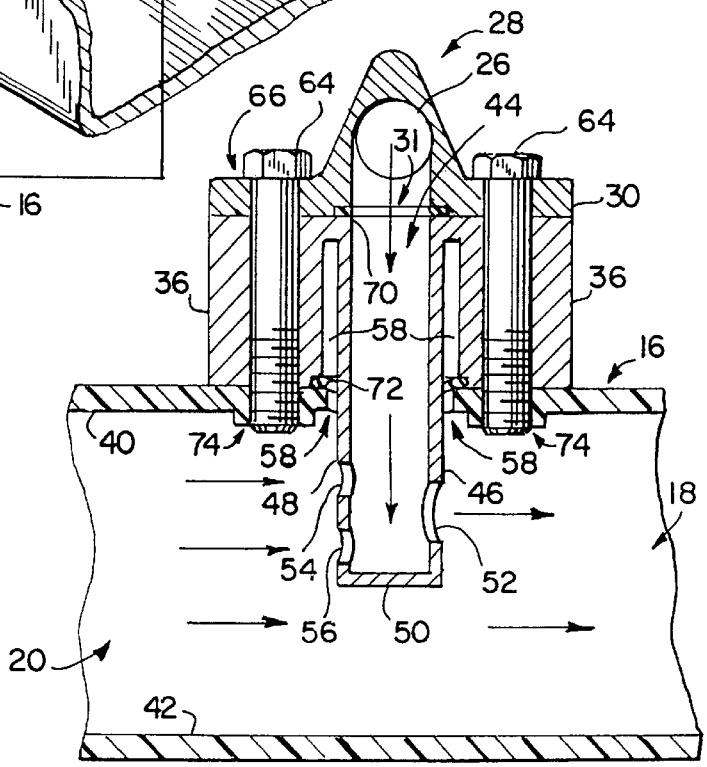
FIG. 3

FIG. 4
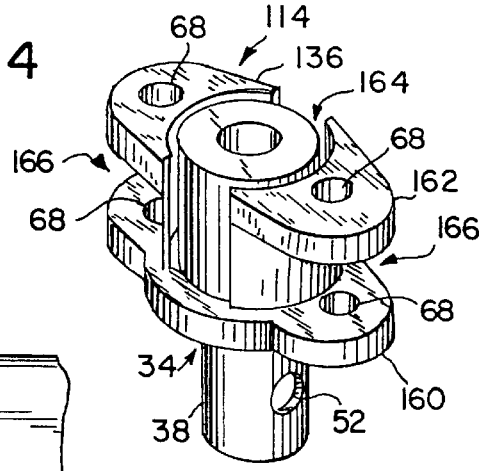
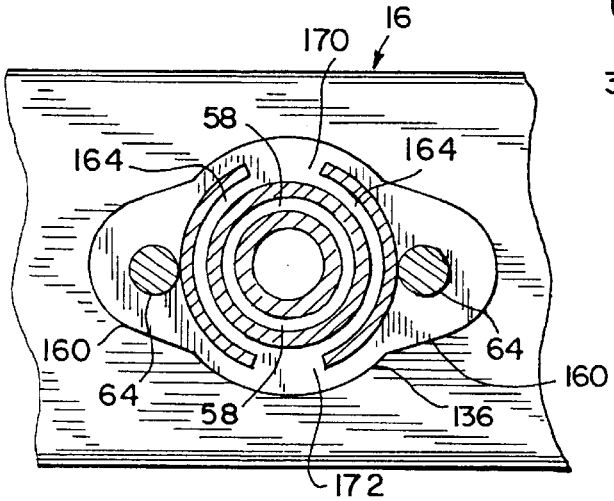
FIG. 6
FIG. 5
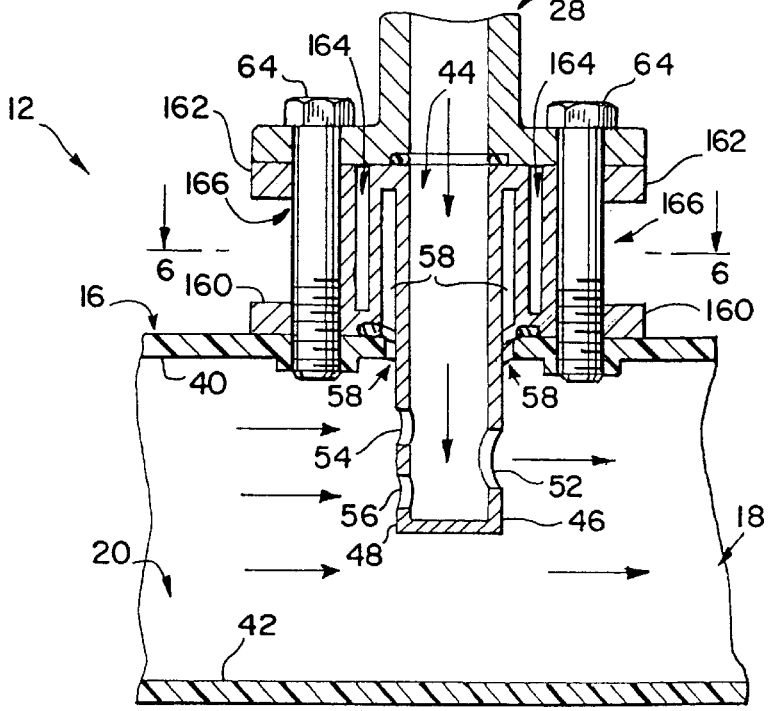

EXHAUST GAS RECIRCULATION SYSTEM

FIELD OF THE INVENTION

The present invention relates generally to a combustion system for engines. More particularly, the present invention relates to an exhaust gas recirculation system for combustion of recycled exhaust gas in a vehicular internal combustion engine. Most particularly, it relates to heat sinks for mounting exhaust gas recirculation (EGR) valves on intake manifolds.

BACKGROUND OF THE INVENTION

It is well known to recycle exhaust gas from a combustion chamber of a vehicular internal combustion engine for re-combustion in the chamber. Such recycling of exhaust gas assists in reducing motor vehicle emissions of particular pollutants, such as nitrogen oxides, and may conserve fuel.

Typically, the exhaust gas is conveyed directly from an exhaust gas source to an intake manifold that is constructed of metal. However, such metal manifolds are disadvantageous because they are costly to fabricate and subject to deterioration (e.g., rust). Intake manifolds constructed of plastic or plastic composites may be less expensive than metallic intake manifolds, however such plastic manifolds are disadvantageous because they may be easily degraded (e.g., melted, charred, etc.) by the high temperature of EGR valves mounted on the intake manifold.

What is needed, therefore, is a heat sink for dissipating the heat of recycled exhaust gas without significantly damaging the intake manifold. Accordingly, it would be advantageous to have a heat sink coupled between the EGR valve and the intake manifold for dissipating enough exhaust gas heat. It would also be advantageous to have a heat sink capable of rapid installation in an engine system. It would further be advantageous to have a heat sink that is readily accessible for rapid service, repair or replacement. It would further be advantageous to have a heat sink that operates for the durable life of a vehicle.

SUMMARY OF THE INVENTION

The present invention relates to an integral heat sink for transferring heat from combustion exhaust gas produced by a vehicular internal combustion engine. The heat sink includes a body providing an integral base configured for support by a manifold. The heat sink also includes a hollow elongate member with a first portion contained in the body. The first portion has an exhaust gas intake. The member also includes a second portion extending from the body. The second portion is configured for insertion into the manifold and provides at least one discharge for the exhaust gas. The heat sink also includes a cavity disposed between the body and the member. The cavity is configured for conveying combustion air from the manifold around at least a portion of the member.

The present invention also relates to an integral heat sink for transferring heat from combustion exhaust gas produced by an internal combustion engine of a vehicle. The heat sink includes a body providing an integral base configured for support by a manifold. The heat sink also includes a hollow elongate member providing a first portion contained in the body. The first portion has an exhaust gas intake. The member also includes a second portion extending from the body. The second portion is configured for insertion into the manifold and provides at least one discharge for the exhaust gas. The heat sink also includes a first cavity disposed between the body and the member. The first cavity is configured for conveying combustion gas from the manifold around the member. The heat sink also includes a second cavity disposed between the body and the first cavity. The second cavity is configured for conveying ambient gas from the atmosphere around the first portion of the member.

The present invention also relates to an exhaust gas recirculation system for transferring heat from exhaust gas having a temperature to the atmosphere. The system includes an intake manifold coupled to the internal combustion engine of a vehicle for communicating exhaust gas to the intake manifold and thence to the combustion chamber of the engine. The system also includes a passage for conveying the exhaust gas from the combustion chamber to an EGR valve. The EGR valve outlet is coupled to the inlet of a heat sink. The heat sink has an integral base supported by the manifold and in fluid flow communication with the passage. The system also includes a hollow elongate member with a first portion contained in the heat sink, the first portion having an exhaust gas intake. The member also has a second portion that extends from the body, is disposed in the manifold and provides at least one discharge for the exhaust gas into the manifold. The system also includes a first cavity for conveying combustion air from the manifold around at least a portion of the member disposed between the heat sink and the member. The system also includes a second cavity for conveying ambient air from the atmosphere around at least a portion of the first portion of the member disposed between the body and the first cavity. The temperature of the exhaust gas is substantially reduced by conveying the exhaust gas from the combustion chamber, through the passage, through the intake of the member and through the discharge.

It is an object of this invention to provide a heat sink for dissipating enough heat to achieve operating temperatures at the heat sink/manifold interface. It is also an object of this invention to provide a heat sink capable of rapid installation in an engine system. It is also an object of this invention to provide a heat sink that is readily accessible for rapid service, repair or replacement. It is also an object of this invention to provide a heat sink that operates for the durable life of a vehicle.

Other principal objects, features and advantages of the invention will become apparent to those skilled in the art upon review of the following FIGURES, the detailed description and the appended claims.

BRIEF DESCRIPTION OF THE FIGURES

FIG. 1 is a fragmentary perspective view of an exhaust gas recirculation system according to a preferred embodiment of the present invention;

FIG. 2 is a perspective view of a heat sink of the exhaust gas recirculation system of FIG. 1;

FIG. 3 is a fragmentary cross-sectional view of the exhaust gas recirculation system of FIG. 1 along line 3—3 of FIG. 1;

FIG. 4 is a perspective view of a heat sink according to an alternative embodiment of the present invention;

FIG. 5 is a fragmentary cross-sectional view of the heat sink of FIG. 4 coupled to a manifold; and FIG. 6 is a cross-sectional view of the exhaust gas system shown in FIG. 5 along line 6—6 of FIG. 5.

DETAILED DESCRIPTION OF THE PREFERRED EMBODIMENTS

Referring to FIG. 1, an engine system 10 providing an exhaust gas recirculation system 12 shown. System 12 includes an EGR valve 13 coupled to a heat sink 14 that is adapted to transfer the heat from exhaust gas, fluid or gas to the atmosphere and to convey exhaust gas from the EGR valve into an intake manifold 16.

During operation of engine system 10, purified air, fluid or gas from an air filter (not shown) is conveyed to intake manifold 16. The purified air through intake manifold 16 conveyed from an upstream end 20, past recirculation system 12 at which point exhaust gas is introduced into the flow of air, to a downstream end 18. The air/exhaust mixture is subsequently conveyed to a combustion chamber of an internal combustion engine 11 where it is mixed with fuel and burned. A portion of the exhaust gas resulting from this burning is recycled through system 12 back into the intake manifold for mixture with purified air.

An exhaust gas induction tube 24 is fluidly coupled to an inlet of system 12 and conveys a portion of the exhaust gas from the combustion chamber to system 12. A fastener (shown as a crimped connector 22) attaches tube 24 to EGR valve 13. EGR valve 13 includes a valve member (not shown) connected to valve pintle 32 for regulating the flow of exhaust gas through the EGR valve. The valve member is disposed in a generally triangular shaped valve body 28 of EGR valve 13. Valve body 28 has an exhaust gas inlet 26 to which induction tube 24 is fluidly coupled and an exhaust gas outlet 31 disposed in a base 30. Base 30 is generally planar and is coupled to heat sink 14 to convey exhaust gas that passes through EGR valve 13 into heat sink 14.

The valve member is controlled by moving pintle 32 into and out of valve body 28 to throttle the flow of exhaust gas. For example, when pintle 32 is in its closed position, substantially no exhaust gas passes through EGR valve 13 and therefore substantially no exhaust gas is recycled through system 12. When pintle 32 is in its open position, exhaust gas is permitted to pass through EGR valve 13 is recycled through system 12.

FIG. 2 illustrates a preferred embodiment of heat sink 14. Heat sink 14 includes an exhaust gas tube 34 and a body 36 to which tube 34 is mounted.

Exhaust gas tube 34 is generally circular in cross-section and has a first portion 44 disposed within and surrounded by body 36. A second (or stem) portion 38 of tube 34 extends coaxially from the first portion and is disposed within intake manifold 16.

Stem portion 38 of exhaust gas tube 34 is disposed between a top wall 40 and a bottom wall 42 of manifold 16. Stem 38 includes a downstream sidewall 46 facing substantially downstream in the manifold and an upstream sidewall 48 facing substantially upstream in the manifold. The free end of stem portion 38 disposed in the intake manifold is enclosed by a stem cap 50 (see FIG. 3).

An opening 52 in downstream sidewall 46 is spaced apart from top wall 40 and directs exhaust gas passing through the heat sink in a substantially downstream direction. Two openings 54 and 56 are provided in upstream sidewall 48 spaced away from top wall 40 and direct exhaust gas passing through the heat sink in a substantially upstream direction. The combined areas of openings 52, 54 and 56 are preferably substantially equal to the area of stem cap 50 so as to allow the rapid release of the exhaust gas through the openings while minimizing the area of stem 38 that blocks the passage of air through the intake manifold. The ratio of the length of the stem to the length of the first portion 44 of the flow tube is preferably at least 1:1. More preferably it is at least 1.5:1, and most preferably it is at least 2:1.

First portion 44 of exhaust gas tube 34 extends into body 36 and extends integrally from stem portion 38. Portion 44 is spaced apart from body 36 and defines a generally cylindrically-shaped cavity 58 between it and body 36. When exhaust gas passes through exhaust gas tube 34, this spacing reduces the heat that is transferred to body 36 and thus the heat that is transferred to the intake manifold. In addition, cavity 58 and thus the outer surface of portion 44 is in fluid communication with combustion air passing through the intake manifold. This permits air in cavity 58 that is heated by the outer surface of first portion 44 to be flushed into the combustion air stream, thus additionally reducing the heat transfer from tube 34 to body 36.

Body 36 includes a base 60 and a flange extension 62, both of which are supported by top wall 40 of manifold 16. Fasteners (shown as threaded bolts 64) inserted through apertures 66 of valve body 28, apertures 68 of body 36, are attached to apertures 74 of manifold 16. These fasteners thereby secure EGR 13 and heat sink 14 to manifold 16.

A generally circular gasket 70 encircles the upper end of first portion 44 of tube 34 to substantially seal the interface between valve body 28 and heat sink body 36 thereby reducing or eliminating the escape of exhaust gases from between the EGR valve and the heat sink.

Another generally circular gasket encircles stem 38 of tube 34 and substantially seals the interface between base 60 of body 36 and top wall 40 of manifold 16. This gasket is disposed between body 36 and the intake manifold, and is spaced away from cavity 58 to permit cavity 58 to be in fluid communication with the interior of the intake manifold.

FIG. 3 illustrates the flow of exhaust gas through system 12. Exhaust gas enters system 12 through inlet 26 at a rate of about 20 cubic feet/minute and a temperature of about 500 degrees Celsius. The exhaust gas passes through EGR valve 13 and thence into first portion 44 of tube 34 to stem 38. The exhaust gas exits stem 38 through opening 52 in the downstream direction, and through openings 54 and 56 in the upstream direction.

Without intending to be limited by theory, it is believed that discharging the exhaust gas in this manner substantially reduces the temperature of top and bottom walls 40 and 42, and sidewalls 46 and 48 of stem 38. In addition, this discharge of exhaust gas through stem 38 provides rapid mixing of the exhaust gas with the purified air in manifold 16 and thus rapid reduction in temperature of the mixture, since the combustion air is generally at a temperature of about 40 degrees C. Such rapid mixing assists in channeling the exhaust gas in the downstream direction such that the exhaust gas is directed away from top wall 40 and bottom wall 42 of manifold 16. The channeling of the exhaust gas in the downstream direction assists in reducing the possibility for degradation of sidewalls 46 and/or 48 due to the temperature of the exhaust gas.

Referring further to FIG. 3, the circulation of the purified air (contained in manifold 16) into cavity 58 of body 36 is shown. The temperature of the purified air is generally lower than the temperature of the exhaust gas, as the purified air has not yet undergone combustion in the combustion chamber. Such circulation of the lower temperature purified air in cavity 58 tends to act as a heat transfer mechanism to reduce the temperature of the exhaust gas in tube 34. As the gas travels through tube 34, the movement of combustion air across the outer surface of tube 34 cools it, and hence reduces the temperature of the exhaust gas traveling through tube 34 toward openings 52, 54 and 56.

Without intending to be limited by theory, it is believed that other heat transfer mechanisms include: the transfer of heat from the exhaust gas in first portion 44 of tube 34 to cavity 58, to body 36 and into the atmosphere; the transfer of heat from the exhaust gas entering inlet 26 directly to body 36 and subsequently to the atmosphere; and/or the transfer of heat between the broad, generally planar interface between heat sink 14 and base 30 of valve body 28, and the broad interface between base 60 of heat sink 14 and top wall 40 of manifold 16. Such heat transfer mechanisms are intended to substantially reduce the temperature of the exhaust gas. For example, exhaust gas having a temperature of about 500 degrees Celsius may be processed by heat sink 14 to have a resulting temperature of less than about 200 degrees Celsius, more preferably to a temperature of less than about 175 degrees Celsius.

FIGS. 4–6 illustrate heat sink 114, an alternative embodiment of heat sink 14. Heat sink 114 differs from heat sink 14 in two respects: a second substantially circular cavity is formed in body 136 of heat sink 114 substantially coaxial with tube 34 and cavity 58, and the flanges of the body 36 of the first embodiment have recesses. Other than the changes wrought by these two modifications (discussed below), the construction and performance of the second embodiment is identical to that of the first embodiment. (An engine, identical to engine 11 shown in FIG. 1, is coupled to the EGR valve and the intake manifold shown in FIGS. 4–6, but has been removed from FIGS. 4–6 for clarity and convenience.)

Two recesses 166 are provided in the flanges extending from opposing sides of body 136 thus dividing the single flanges of body 36 into a base flange 160 that is coupled to the intake manifold and a top flange 162 that is coupled to EGR valve 13. By providing these recesses, heat that is transferred from tube 34 to body 136 has a limited thermal conduction path downward toward intake manifold 16, as compared to body 36 of the first embodiment.

Cavity 164 similarly provides an additional thermal barrier to heat traveling outward from exhaust gas tube 34 toward body 136. Cavity 164 is formed in body 136 concentric with and extending around cavity 58. Unlike cavity 58, cavity 164 is open to the atmosphere surrounding heat sink 114—the atmosphere outside of intake manifold 16—and permits heat transfer to the outside atmosphere. Two openings 170, 172 are provided on either side of cavity 164 to permit outside air to enter cavity 164 and carry heated air away from body 136.

Without intending to be limited by theory, it is believed that the following heat transfer mechanisms exist in heat sink 114: recess 166 and flanges 160 and 162 provide additional surface area for heat transfer from body 136 to the atmosphere; internal cavity 58 provides a space for outside air to transfer exhaust gas heat from first portion 44 of tube 34 to body; and/or external cavity 164 provides a space for atmospheric or ambient air to transfer heat from body 136 to the atmosphere.

According to a particularly preferred embodiment, the manifold is constructed of a sulfur containing thermoplastic or thermosetting resin, such as PPS® resin commercially available from Phillips Petroleum Company of Bartlesville, Okla., having a heat transfer property of about k=0.166 W/M/C. The heat sink is preferably constructed of a low carbon steel, such as 1010 or 1020 carbon steel, having a heat transfer property of about k=50.1 W/M/C. The manifold is preferably a cylindrical shaped having a diameter of about 70-mm and a wall thickness of about 1.5-mm. The stem of the heat sink preferably has a diameter of about 19-mm and extends beyond the top wall of the manifold about 36 mm toward the bottom wall of the manifold.

According to an alternative embodiment, the engine system may be controlled by a control system. The control system may include a controller, a general purpose computer having a central processing unit (CPU), control circuits activated by input devices, power sources, memory storage modules, display systems and/or instrumentation (e.g., regulators, sensors for monitoring temperature, volume, pressure and/or other variables, heating and/or cooling systems, etc.) and the like. The control system may be implemented in a stand-alone digital processor, or integrated with a microprocessor of the like used to monitor and/or control engine systems and engine functions. (According to other alternative embodiments, the controller and an associated control program may be implemented in hardware, software or a combination thereof, or in a central program implemented in any of a variety of forms.) A differential pressure feedback element (e.g., DPFE sensor) may provide feedback to the controller signaling when the exhaust gas recirculation system is operating at an acceptable pressure drop. In response, the controller may signal an electric vacuum regulator to increase or decrease the vacuum level in the engine recycling system by positioning the pintle to the opened or the closed position, or some combination thereof.

The foregoing description has been presented for purposes of explanation and illustration only, and is neither exhaustive nor restrictive. Although only a few exemplary embodiments have been described, the present invention is not limited to one particular embodiment. Indeed, to practice the invention in a given context, those skilled in the art may conceive of variations to the embodiments described herein without materially departing from the true spirit and scope of the invention. For example, variations may be made in sizes, structures, shapes and proportions of the various elements, values of parameters, mounting arrangements, and/or use of materials. Any suitable fastening device (e.g., welding, ultrasonic welding, vibration welding, molding, glue, screws, rivets, clamps or other conventional methods) may attach the heat sink to the manifold. The gaskets may be constructed of any rigid or flexible material such as urethane rubber, Viton® rubber, Teflon® polymers, etc. The manifold may be constructed of any plastic, such as polyphenylensulfide, thermoplastic or a synthetic resin such as Minlon® 10B40 commercially available from E. I. Du Pont de Nemours and Company of Wilmington, Delaware. The heat sink may be constructed of any metal, such as stainless steel or magnesium, or any metal alloy. A baffle having any of a variety of shapes (e.g., star-shaped) may be provided in the stem to further increase the heat transfer properties of the heat sink.

It should be noted that the use of the term "tube" is not meant as a term of limitation, insofar as any valve, hose, conduit, or like structure providing a channel or passage through which air may flow is intended to be included in the term. It should also be noted that the use of the term "conveyed" is not meant as a term of limitation, insofar as any routing, direction or leading of fluid, gas or air through the engine system and the exhaust gas recirculation system is intended to be included in the term. It should also be noted that the use of the term "engine" is not meant as a term of limitation, insofar as any "engine" or like machine for using fuel to produce motion is intended to be included in the term.

Thus, it should be apparent that there has been provided in accordance with the present invention an exhaust gas recirculation system that fully satisfies the objectives and advantages as set forth above. Although the invention has been described in conjunction with specific embodiments thereof, it is evident that many alternatives, modifications and variations will be apparent to those skilled in the art. Accordingly, the invention is intended to embrace all such alternatives, modifications and variations that fall within the spirit and broad scope of the appended claims. Other substitutions, modifications, changes and omissions may be made in the design, operating conditions and arrangement of the preferred embodiments without departing from the spirit of the invention as expressed in the appended claims.

For example, while flanges are shown as the method for mounting bodies 36 and 136 to the EGR valve and the manifold, other structures may be employed such as screws, bolts, nuts rivets, welding and the like. Furthermore, bodies 36 and 136 may have external or internal structures, such as threads, to permit them to be fastened directly to the intake manifold or EGR valve. In addition, while in the preferred embodiment an EGR valve is attached to the heat sink, the EGR valve may be disposed away from the intake manifold and communicate with the heat sink via a tube or similar conduit that fluidly couples the EGR valve to the heat sink. Even further, while the various cavities are shown as complete cylinders surrounding tube 34, there may nonetheless be rods, struts, or ribs extending between the body to tube 34 to help support tube 34 within the cavities.

The embodiments of the invention in which an exclusive property or privilege is claimed are recited as follows:

1. An integral heat sink for transferring heat from combustion exhaust gas produced by a vehicular internal combustion engine, comprising:

a body providing an integral base having a flange extending from the base, with the base configured for support by a manifold;

a hollow elongate member providing a first portion contained in the body, the first portion having an exhaust gas intake, and a second portion extending from the body, the second portion configured for insertion into the manifold and providing at least one discharge opening for the exhaust gas;

a cylindrical shaped cavity disposed between the body and the member and configured for conveying combustion air from the manifold around at least a portion of the member, wherein the cavity provides a heat exchange pathway between the member and the body; and, a second cavity disposed between the body and member and configured for conveying combustion gas from the manifold around the first portion of the member.

2. An integral heat sink for transferring heat from combustion exhaust gas produced by a vehicular internal combustion engine, comprising:

a body providing an integral base configured for support by a manifold;

a hollow elongate member providing a first portion contain in the body, the first portion having an exhaust gas intake, and a second portion extending from the body, the second portion configured for insertion into the manifold and providing at least one discharge for the exhaust gas;

a first cavity disposed between the body and the member and configured for conveying the combustion air from the manifold around the member;

a second cavity disposed between the body and the first cavity and configured for conveying ambient gas from the atmosphere around the first portion of the member.

3. The heat sink of claim 2, further comprising a channel disposed between a first flange extending from the base and a second flange extending from the body.

4. The heat sink of claim 3, wherein the first portion of the member has a length at least as long as the length of the second portion of the member.

5. The heat sink of claim 4, wherein the discharge of the second portion is configured to extend at least one half the distance between a first wall and a second wall of the manifold.

6. An exhaust gas recircul ation system for transferring heat from exhaust gas havin gate mperature to the atmosphere, comprising:

an internal combustion engine for a vehicle that produces the exhaust gas in a combustion chamber;

a channel for conveying the exhaust gas from the engine;

a heat sink, including a hollow elongate member and a heat sink body, the member including a first portion contained in the body and having an exhaust gas intake fluidly coupled to the channel to receive the exhaust gas, and the member including a second portion extending from the body and having a discharge opening, where in the member and the body are disposed to provide a first cavity between the member and the body, the heat sink having a second substantially cylindrical cavity disposed about the first cavity and in fluid communication with ambient air;

an intake manifold coupled to the heat sink and to the engine to conduct combustion air and exhaust gas to the engine and having a manifold opening for receiving the second portion into the interior of the intake manifold, wherein the second portion is disposed within the manifold opening such that the first cavity is in fluid communication with the interior of the intake manifold, and wherein the temperature of the exhaust gas is substantially reduced by conveying the exhaust gas from the engine, through the channel, through the intake of the member, through the discharge opening and into the interior of the intake manifold.

7. The heat sink of claim 6, wherein a first cylinder of air from the manifold and a second cylinder of air from the atmosphere surround at least a portion of the member to reduce the temperature of the exhaust gas and the conduction of heat from the member to the intake manifold.

8. The heat sink of claim 7, wherein the first cylinder of air and the second cylinder of air reduce the temperature of the exhaust gas by at least one half.

9. The heat sink of claim 7, wherein an interface between the base and the manifold is generally planar.

10. The heat sink of claim 9, wherein the heat sink is made of metal.

11. The heat sink of claim 10, wherein the intake manifold is disposed in a combustion air path to conduct purified combustion air to the engine.

12. The heat sink of claim 11, wherein the manifold is constructed of plastic.

13. The heat sink of claim 12, wherein the diameter of the member is greater than half the length of the second portion of the member.

* * * * *